United States Patent [19]

Webb et al.

[11] 4,068,988

[45] Jan. 17, 1978

[54] POSITIVE-DISPLACEMENT, FLUID MACHINE

[75] Inventors: Paul Dale Webb, Tioga, Pa.; Larry Neil Willover, Painted Post, N.Y.

[73] Assignee: Ingersoll-Rand Company, Woodcliff Lake, N.J.

[21] Appl. No.: 710,123

[22] Filed: July 30, 1976

[51] Int. Cl.[2] ..... F04C 17/04; F04C 29/00

[52] U.S. Cl. ..... 418/189; 418/206

[58] Field of Search ..... 418/180, 189, 205, 206, 418/191, 196, 200; 123/8.25, 8.43; 417/285

[56] References Cited

U.S. PATENT DOCUMENTS

| | | | |
|---|---|---|---|
| 3,392,676 | 7/1968 | Bizier | 123/8.43 X |
| 3,844,695 | 10/1974 | Weatherston | 418/180 |
| 3,989,413 | 11/1976 | McGahan | 418/206 X |

FOREIGN PATENT DOCUMENTS

| | | | |
|---|---|---|---|
| 1,094,281 | 5/1955 | France | 418/79 |
| 910,465 | 11/1962 | United Kingdom | 418/180 |

*Primary Examiner*—William L. Freeh
*Assistant Examiner*—Leonard Smith
*Attorney, Agent, or Firm*—Bernard J. Murphy

[57] ABSTRACT

In the embodiment of the invention as depicted, the same comprising a rotary compressor, a channel or passageway is provided in the machine to communicate two variable volume chambers which are formed by rotary pistons and walls of the compressor housing, to equalize pressure in the two chambers. The purpose here is to prevent one chamber from pre-compressing before the other, so that a small pocket formed between the rotors by the inter-engaging teeth will not come up to pressure, and be expanded back into the inlet, to avoid a clearance loss and a waste of horsepower.

3 Claims, 8 Drawing Figures

POSITIVE-DISPLACEMENT, FLUID MACHINE

Figure 1:
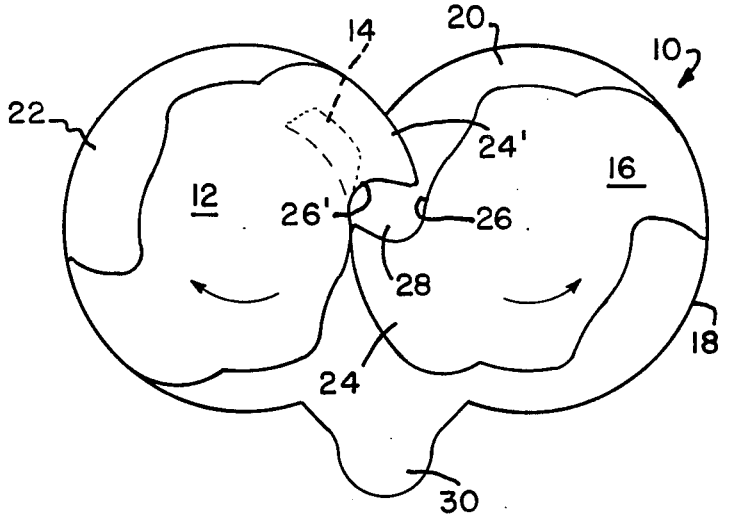
FIG. 1 PRIOR ART

In some positive-displacement, fluid machines, i.e., compressors, pumps, expanders, and the like, and especially in gas compressors having rotary pistons with inter-engaging teeth or lobes and recesses, the lobes form a pocket which closes upon and traps gas therewithin and carries the trapped gas back to the inlet where, while having just been compressed, it is now expanded. The rotary pistons, in cooperation with the walls of the compressor housing, define a pair of separate and discrete chambers which, subsequently, merge into one. Yet, without an equalizing passage between the chambers, one of the chambers, i.e., one, or the one which communicates with the pocket comes up to pressure, while the other chamber remains at inlet pressure. The pocket forms, the gas therein is charged to the high pressure subsisting in the communicating chamber, next the pocket fully closes, and then the trapped gas therein is carried back to inlet. The pocket-trapped pressurized gas going back to inlet, plus the pre-compression of the one chamber, prior to its merger with, and subsequent expansion of its gas into, the other chamber causes some significant loss of efficiency.

To improve efficiency, to avoid such loss, it is already known in the prior art to provide an equalizing passage circumferentially of the housing at the intersection of the two rotor bores. This provides chambers' equalization and therefore prevents pre-compression of the one chamber. Too, it reduces losses since the lobe-formed pocket is at substantially inlet pressure when carried back to inlet. However, a disadvantage of this prior art chambers' equalizing method is that the equalizing passage is under both full discharge pressure and inlet pressure during the compression cycle. Thus, the volume of the passage represents a clearance loss.

The present invention provides the desired chambers' equalizing relief; however, it has as an object a means of equalizing pressure in two merging chambers of a positive-displacement, fluid machine, such as a rotary compressor, with minimum losses.

Particularly, it is an object of this invention to set forth a positive-displacement, fluid machine, such as a compressor, pump, expander, and the like, comprising a walled housing; first means for admitting fluid into said housing; second means for discharging fluid from said housing; third means cyclically-movably disposed within said housing having given surfaces formed thereon which cooperate with walls of said housing to define a given chamber having a first volume, upon said third means effecting a first prescribed movement, and having a second volume, upon said third means effecting a second prescribed movement, to enclose fluid admitted to said housing cyclically within said first and second volumes of said chamber; and orifice means opening onto said chamber to vent said chamber; wherein said third means further have means occluding said orifice means, coincident with said chamber achieving a volume intermediate said first and second volumes, to halt venting of said chamber.

Another object of this invention is to disclose a positive-displacement, fluid machine, such as a compressor, pump, expander, and the like, comprising a walled housing; first means for admitting fluid into said housing; second means for discharging fluid from said housing; and third means movably disposed within said housing having surfaces formed thereon which cooperate with walls of said housing to define a plurality of chambers within said housing, which chambers, as a consequence of movement of said third means, vary cyclically from chambers of fixed volume to chambers of diminishing volume; said housing having means which define an open fluid-communication of a first, fixed-volume chamber with a second, diminishing-volume chamber; and wherein said third means further have means which close off said communication prior to said first chamber cyclically undergoing a diminution of its volume.

Yet a further object of this invention is to teach a positive-displacement, fluid machine, such as a compressor, pump, expander, and the like, comprising a walled housing; first means for admitting fluid into said housing; second means for discharging fluid from said housing; and third means cyclically-movably disposed within said housing having surfaces formed thereon which cooperate with walls of said housing to define a plurality of discrete and separate chambers within said housing, which chambers, as a consequence of movement of said third means, open onto one another and together define a single chamber; said housing having means effecting a common fluid-communication between said discrete chambers; and wherein said third means further have closure means which seals off said communication prior to said chambers opening onto one another.

Figure 2:
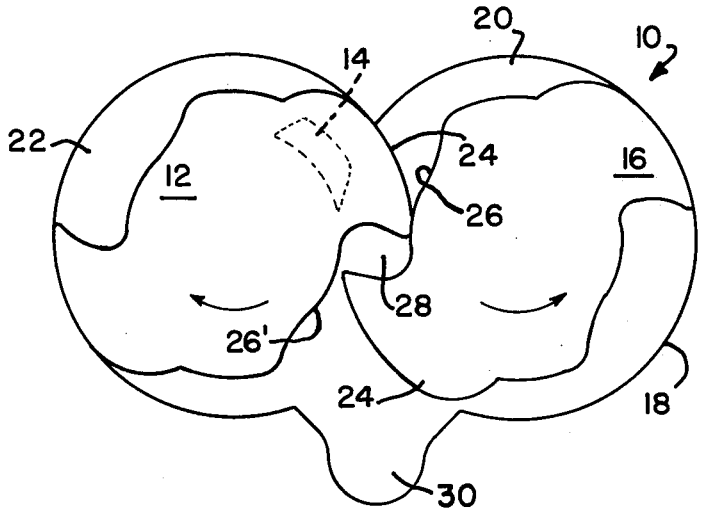
FIG. 2 PRIOR ART
Figure 3:
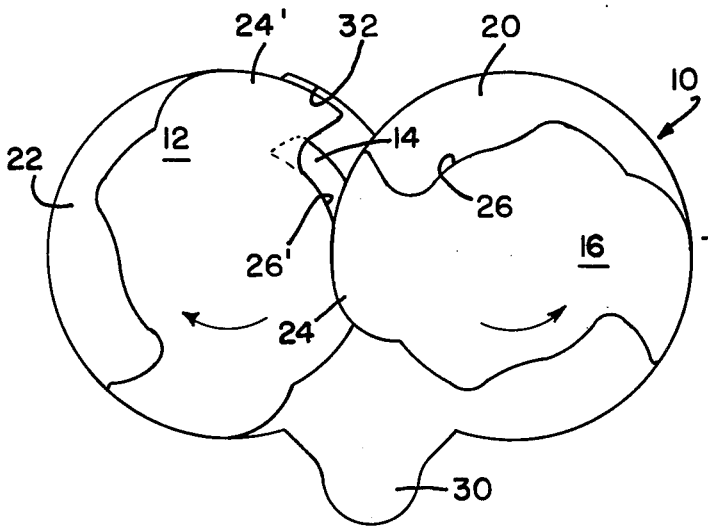
FIG. 3 PRIOR ART
Figure 4:
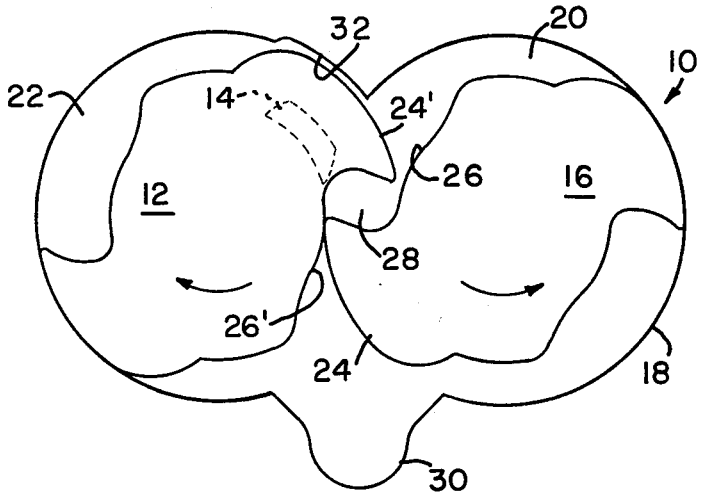
FIG. 4 PRIOR ART
Figure 5:
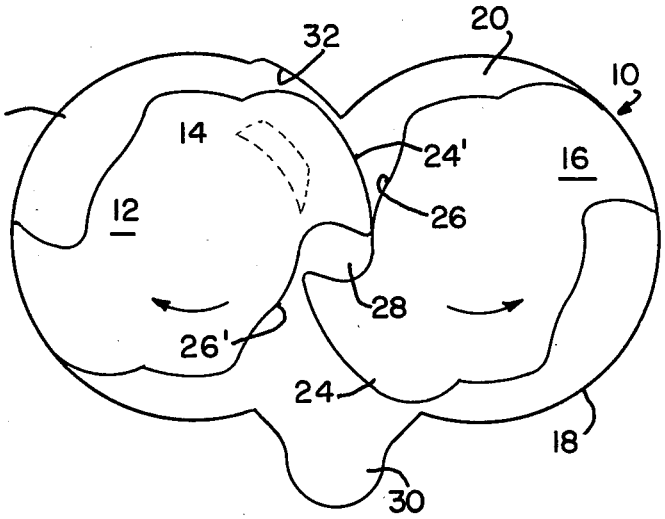
FIG. 5 PRIOR ART
Figure 6:
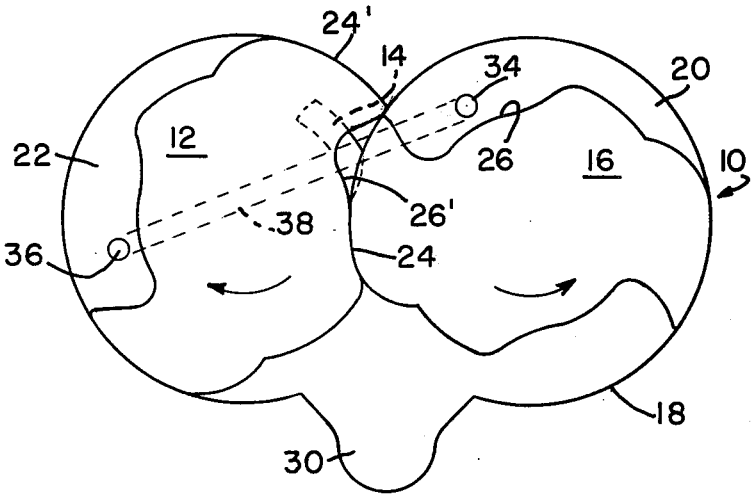
Figure 7:
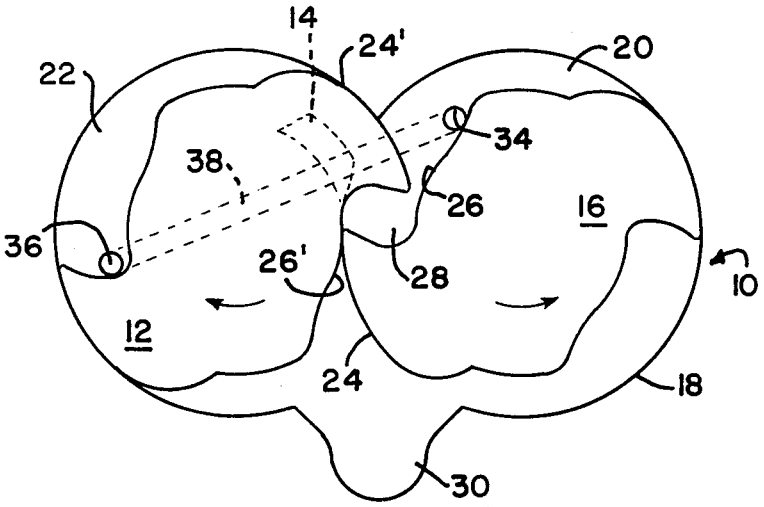
Figure 8:
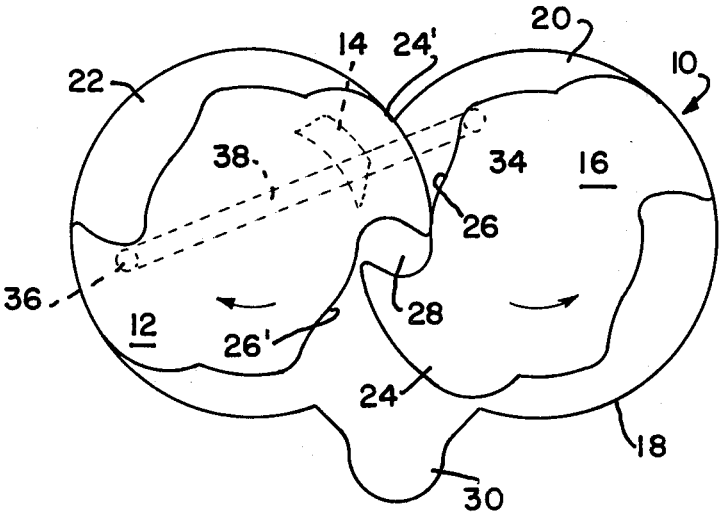

Further objects of the invention as well as the novel features thereof will become more apparent by reference to the following description taken in conjunction with the accompanying figures in which:

FIGS. 1 and 2 depict, in simple line-illustration views, a typical rotary compressor having a pair of rotary pistons, the same comprising a gate rotor and a main rotor, in successive or sequenced stages of cycle;

FIGS. 3 through 5 are line illustrations, like those of FIGS. 1 and 2, of a prior art pressure relief arrangement for equalizing pressure in two distinct chambers of the compressor; and FIGS. 6 through 8 present line illustrations of a rotary compressor in three, sequential stages during the operating cycle showing the improved means incorporated therewith for equalizing chamber pressure.

As shown in FIGS. 1 and 2 a typical rotary compressor 10 employs a gate rotor 12 (rotary piston) which cyclically occludes and exposes the exhaust port 14 and which cooperates with a main rotor 16 (rotary piston) to define, within the housing 18 of the machine, a pair of separate and distinct chambers 20 and 22. Chambers 20 and 22 merge, as the rotors pressurize the gas and, in turn, discharge the compressed gas product through the exhaust port 14. The geometry of the rotors 12 and 16 is such that, necessarily, the teeth or lobes 24 and 24' and recesses 26 and 26' therefor define a sub-chamber or pocket 28 therebetween. Pocket 28 is adjacent and appendant to chamber 20. Thus, gas confined within the pocket 28 is pressurized to a preliminary pressure which subsists in the diminishing-volume chamber 20. The pocket closes, and then the gas therein is discharged to the inlet 30, or the inlet side of the compressor. In order to avoid this "product" loss, prior art machines of this type, i.e., rotary compressors, employ a relief groove 32 (FIGS. 3–5) which is formed about the periphery of the rotor bore in the housing 18 which carries the gate rotor 12. By noting the sequence or progression of rotor travel, in FIGS. 3–5, it can be seen that, just prior to closure of the pocket 28, the relief groove 32 communicates chambers 20 and 22—thus, both chambers and the pocket 28 are under common pressure, substantially inlet pressure. Upon the pocket 28 closing, and opening to the inlet 30, then, there is no loss of "product" to the inlet; i.e., no pocket-confined gas has been over-compressed and re-expanded into the inlet side of the machine.

However, it will also be noted that the relief groove 32 first comes up to pressure, as can be seen in FIG. 3, and remains at pressure, full discharge pressure, until the discharge cycle is completed. Then the relief groove 32 opens onto chamber 22 which, at this time, is only at inlet pressure. Accordingly, the volume of the relief groove represents a clearance loss. According to our invention, an embodiment of which is shown in FIGS. 6 through 8, improved means are employed to equalize the pressure of chambers 20 and 22. In the embodiment shown, a relief hole 34 and a feedback hole 36 are provided in the two housing bores, and communicate therebetween by means of a conduit 38 formed in the housing 18.

With reference to FIGS. 6 and 7, it will be seen that both chambers 20 and 22 are in free communication during these progressive stages of machine operation. Just before chamber 20 commences to pressurize, the main rotor 16 occludes the relief hole 34 and, at the same time, the gate rotor 12 occludes the feedback hole 36. Now, as the machine comes up to full pressure, there is no communication between the two chambers. With especial reference to FIGS. 7 and 8 it will be noted that chambers 20 and 22 and the closing pocket 28, which is appended to chamber 20, are all kept at a common (substantially inlet) pressure until the pocket 28 closes. Following this, both chambers 20 and 22 merge and come up to pressure. The chambers' equalizing conduit 38 is inoperative, and gas trapped within the pocket 28 is substantially at inlet pressure when returned to the inlet 30. Accordingly, by means of this improvement, there is no clearance loss in the chambers' equalizing arrangement, and only a minimum gas volume loss in the gas trap pocket 28.

While we have described our invention in connection with a specific embodiment thereof it is to be clearly understood that this is done by way of example and not as a limitation to the scope of our invention as set forth in the objects thereof and in the appended claims.

We claim:

1. A positive-displacement, fluid machine, such as a compressor, pump, expander, and the like, comprising:

a housing having end walls and arcuate side walls;

first means for admitting fluid into said housing;

second means for discharging fluid from said housing;

rotary piston means cyclically-movably disposed within said housing to rotate therewithin on axes normal to said end walls;

said rotary piston means having given surfaces formed thereon which cooperate with said walls of said housing to define a given chamber having a first volume, and to define another chamber having a maximum volume, upon said piston means effecting a first prescribed movement, and to define said another chamber as having a minimum volume, upon said piston means effecting a second prescribed movement, to enclose fluid admitted to said housing within said given and another chambers; and means, formed in said end walls and spaced inwardly of said side walls, opening onto both said given and another chambers to cause said chambers to be in fluid communication; wherein said piston means further has means occluding said means coincident with said another chamber achieving a volume intermediate said maximum and minimum volumes and retention of said first volume by said given chamber, to halt said fluid communication of said chambers; wherein said piston means comprises a plurality of interengaging rotary pistons having mating lobes and recesses;

said lobes and recesses, together with said walls, cooperatively define therebetween a fluid pocket, adjacent and appendant to said another chamber, which, upon movement of said pistons, closes off from said another chamber and traps fluid therewithin; and said occluding means halts said fluid communication of said chambers only following a closing off of said pocket.

2. A positive-displacement, fluid machine, such as a compressor, pump, expander, and the like, comprising:

a walled housing;

first means for admitting fluid into said housing;

second means for discharging fluid from said housing; and third means cyclically-movably disposed within said housing having surfaces formed thereon which cooperate with walls of said housing to define a plurality of discrete and separate chambers within said housing, which chambers, as a consequence of movement of said third means, open onto one another and together define a single chamber;

said housing having means effecting a common fluid-communication between said discrete chambers; wherein said third means further have closure means which seals off said communication prior to said chambers opening onto one another;

said third means comprise a plurality of interengaging rotary pistons having mating lobes and recesses;

said lobes and recesses, together with said walls, cooperatively define a fluid pocket, adjacent and appendant to one of said discrete and separate chambers, which pocket, upon movement of said pistons, closes off from said one discrete and separate chamber and traps fluid therewithin; and said closure means seals off said communication between said discrete and separate chambers only following a closing off of said pocket.

3. A machine, according to claim 2, wherein:

said fluid-communication means comprises passageway means opening commonly onto said chambers.

* * * * *